United States Patent [19]

Gagneux et al.

[11] Patent Number: 5,000,475

[45] Date of Patent: Mar. 19, 1991

[54] SKI HAVING IMPROVED SHOCK ABSORPTION AND VIBRATION RESISTANCE

[75] Inventors: Yves Gagneux, Annecy Le Vieux; Denis Gasquet; Maurice Legrand, both of Annecy, all of France

[73] Assignee: Salomon S.A., Annecy Cedex, France

[21] Appl. No.: 194,320

[22] Filed: May 16, 1988

[30] Foreign Application Priority Data

May 22, 1987 [FR] France ..... 87 07544

[51] Int. Cl.[5] ..... A63C 5/00

[52] U.S. Cl. ..... 280/602; 280/601; 280/610

[58] Field of Search ..... 280/601, 602, 608, 609, 280/610; 441/68

[56] References Cited

U.S. PATENT DOCUMENTS

| | | | |
|---|---|---|---|
| 2,695,178 | 11/1954 | Rheinfrank, Jr. | 280/610 |
| 3,132,874 | 5/1964 | Baudou | 280/610 |
| 3,208,761 | 9/1965 | Sullivan et al. | 280/610 |
| 3,503,621 | 3/1970 | Schmidt et al. | 280/610 |
| 3,635,482 | 1/1972 | Holman | 280/610 |
| 3,758,126 | 9/1973 | Zemlin et al. | 280/602 |
| 4,261,778 | 4/1981 | Albrigtsen et al. | 28/610 X |
| 4,405,149 | 9/1983 | Piegay | 280/602 |
| 4,627,635 | 12/1986 | Koleda | 280/610 X |

FOREIGN PATENT DOCUMENTS

| | | | |
|---|---|---|---|
| 0193519 | 9/1986 | European Pat. Off. | |
| 285096 | 6/1915 | Fed. Rep. of Germany | 280/610 |
| 1428862 | 12/1968 | Fed. Rep. of Germany | 280/610 |
| 2133664 | 1/1973 | Fed. Rep. of Germany | 280/610 |
| 2706739 | 9/1977 | Fed. Rep. of Germany | 280/610 |
| 0985174 | 7/1951 | France | |
| 1124600 | 10/1956 | France | |
| 53-21629 | 2/1978 | Japan | 280/610 |
| 406933 | 8/1966 | Switzerland | 280/610 |

*Primary Examiner*—Charles A. Marmor
*Assistant Examiner*—Tamara L. Finlay
*Attorney, Agent, or Firm*—Sandler, Greenblum & Bernstein

[57] ABSTRACT

A ski for use on snow comprises a longitudinally extending body defining a longitudinal median plane and having a sole substantially perpendicular thereto for slidably engaging a surface. The sole has a central zone lying between front and rear contact lines. The width of the body is established by opposed lateral surfaces, and the thickness of the body is established by an upper wall opposed to the sole. A longitudinal core extends along the length of the body between front and rear ends of the ski and has a width established by lateral side walls that respectively face the lateral surfaces of the body. The thickness of the core is established by upper and lower walls. The ski also includes mechanical resistance elements, internal longitudinal shock absorption members made of a viscoelastic material, and filling elements connecting the resistance elements to the other elements. The internal shock absorption members are in the form of a pair of lateral strips of viscoelastic material, each strip being sandwiched between a lateral surface of the body and the facing lateral wall of the core. The lateral side walls of the core make respective inclination angles A and B with the sole of the body, the inclination angles being a nonconstant function of the length of the core for effecting mechanical shock absorption properties which vary longitudinally along the body.

42 Claims, 2 Drawing Sheets

Fig - 1
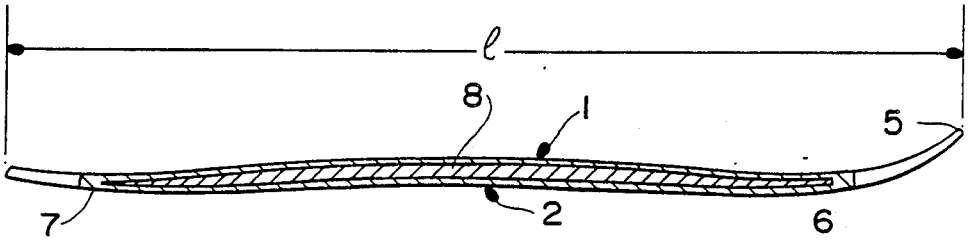
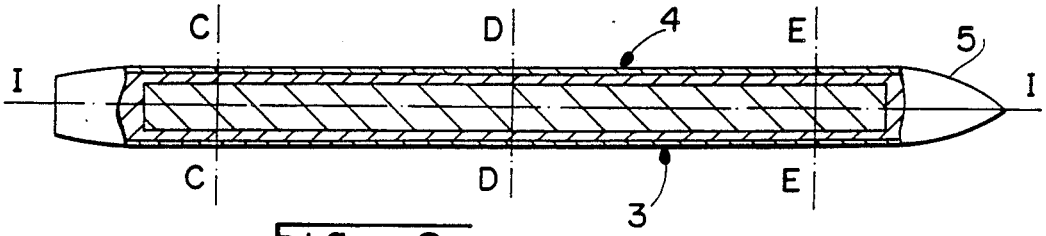
Fig - 2
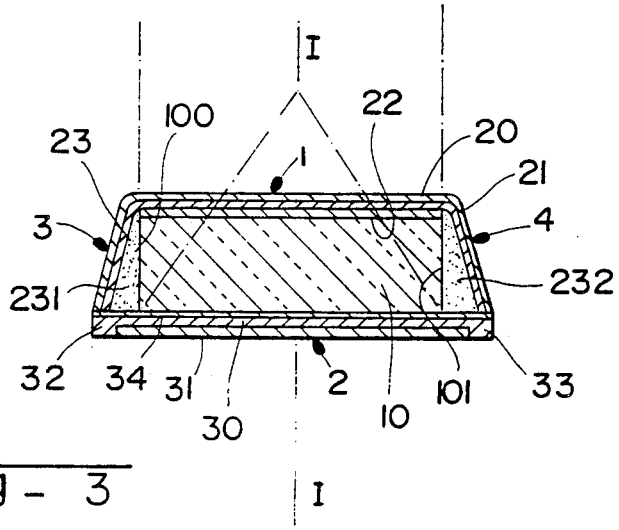
Fig - 3

SKI HAVING IMPROVED SHOCK ABSORPTION AND VIBRATION RESISTANCE

BACKGROUND OF THE INVENTION

1. Field of the Invention

This invention relates to skis utilized in Winter sports, and adapted to slide on snow and ice.

2. Related Applications

The following copending applications disclose subject matter related to subject matter in the present application:

Ser. No. 156,962 filed Feb. 18, 1988;
Ser. No. 157,467 filed Feb. 18, 1988;
Ser. No. 194,147 filed May 16, 1988 (P6373);
Ser. No. 194,129 filed May 19, 1988 (P6374).

3. Description of Background and Relevant Information

A ski generally comprises a lower sliding surface having an angle iron on each lateral edge for gripping snow, two lateral surfaces defining the width of the ski, and an upper surface having binding means located in a central binding zone by which a user attaches his boot to the ski. The front or leading end of the ski is curved upwardly to form a spatula; and the ski is relatively narrow in width compared to its length which defines a longitudinal direction. The lower surface of the ski defines a contact zone located between a front contact line and a rear contact line.

In conventional skis, the thickness of the body of the ski varies along the length of the ski in the longitudinal direction having a maximum in the central binding zone where the flexional movements are a maximum during the use of the ski. In this zone, internal flexion couples are greatest during the use of the ski. Because the thickness of the ski in the central binding zone is a maximum, and the thickness near the front and rear ends is a minimum, a uniform load distribution is achieved as disclosed in French Patent No. 985,174, for example.

Conventional skis have a composite structure in which different materials are combined in a manner such that each composite operates in optimal fashion taking into account the distribution of the mechanical stresses. The composite structure comprises resistance or reinforcing strips of a material having a high mechanical resistance to strain and substantial rigidity so as to resist flexional and torsional stresses produced in a ski during its use. The conventional structure usually includes filler material, and sometimes shock absorption strips.

The two principal composite structures finding current wide scale application in skis are the so-called sandwich and casing structures. In a typical casing structure, such as described in French Patent No. 985,174, and FIG. 3 of French Patent No. 1,124,600, the ski comprises an internal core made of cellular material which may be partially hollow, and mechanical resistance strips surrounding the core in the form of layers that constitute a casing for the core.

In a typical sandwich structure, such as described in U.S. Pat. No. 4,405,149, the ski comprises a central core formed from cellular material which can be partially hollow, and reinforcements on its upper and lower surfaces formed by resistance layers having requisite resistance and rigidity properties greater than those of the core itself. Typically, discontinuous strips of prestressed viscoelastic material are bonded to the core along two or three separate longitudinally spaced zones. At least one of these zones is near the spatula of the ski, and another of the zones is located adjacent the binding zone. Swiss Patent No. 525,012 discloses longitudinal strips formed of viscoelastic material bonded to the upper surface of the ski to form a sandwich structure.

In all of the known skis using a sandwich construction in which the shock absorption strips are formed of viscoelastic material, both the core and the strips have a uniform width along their entire length. When the strips are positioned substantially over the entire length of a ski, it has been found that skiing comfort is improved, but that the gripping and holding power of the ski during turning maneuvers are reduced. In efforts to solve this problem, it has been proposed to limit the length of the shock absorber to the front half of a ski, i.e., to the zone between the spatula and the binding zone. Such an expedient, however, appears to provide no advantage over a construction in which the shock absorber extends over the entire length of the ski. Finally, in the case where the strip is segmented or divided into a plurality of separate segments, as is described in U.S. Pat. No. 4,405,159, the shock absorption effect is reduced, and the influence of the segments becomes practically negligible at the frequencies of vibration produced in the ski under normal use when a boot is attached to the ski by a binding.

Furthermore, in conventional skis using a sandwich construction, the shock absorption element constitutes a supplemental element which complicates the manufacture of the ski and substantially increases its cost.

An object of the present invention, therefore, is to overcome the disadvantages of known ski structures and provide a ski whose shock absorption properties are such as to produce a remarkable increase in both comfort and technical performance.

Another object of the invention is to confer to the body of the ski, a shock absorption property which is a non-constant function of the length of the ski. A further object of the present invention is to obtain a desired non-constant distribution in the shock absorption properties of a ski without major modification of its structure in order to achieve homogeneity of structure and behavior, and good distribution of reactions along the length of the ski thus providing the user with an impression of comfort and regularity in the reactions of the ski to its travel on snow.

SUMMARY OF THE INVENTION

A ski according to the present invention for use on snow comprises a longitudinally extending body defining a longitudinal median plane and having a sole substantially perpendicular thereto for slidably engaging a surface. The sole has a central zone lying between front and rear contact lines. The width of the body is established by opposed lateral surfaces, and the thickness of said body is established by an upper wall opposed to said sole. A longitudinal core extends along the length of the body between front and rear ends of the ski and has a width established by the sole and the lateral side walls that respectively face the lateral surfaces of the body. The thickness of the core is established by upper and lower walls. The ski also includes mechanical resistance elements, internal longitudinal shock absorption means made of a viscoelastic material, and filling elements connecting the resistance elements to the other elements.

According to the present invention, the internal shock absorption means are in the form of a pair of lateral strips of viscoelastic material, each strip being sandwiched between a lateral surface of said body and the facing lateral wall of the core. The lateral side walls of said core make respective inclination angles A and B with the sole of the body, the inclination angles being a nonconstant function of the length of the core for effecting mechanical shock absorption properties which vary longitudinally along the body.

Preferably, but not necessarily, the inclination angles A and B are equal, and the width of the core is substantially constant along the length thereof. In general, the inclination angles A and B of the lateral side walls of the core in said central zone exceed the corresponding inclination angles A and B adjacent the front contact line of the ski. Furthermore, inclination angles A and B of the lateral side walls of the core in said central zone may exceed the corresponding inclination angles A and B adjacent the rear contact line of the ski.

As a consequence of this construction, a predetermined distribution of shock absorption properties can be built into a ski. Vibrations that are most disturbing during the time a ski is in use are reduced by the structure according to the present invention so as to be almost imperceptible. Simultaneously, the absence of vibrations in the same range of frequencies produces a substantial increase in the gripping power of the ski on ice or hard snow, in its stability on bumpy snow, and in its stability in turns, and during its sliding.

The present invention thus provides a ski whose body comprises a longitudinal core, mechanical resistance strips, internal longitudinal shock absorption means of viscoelastic material, and filling material connecting the resistance strips to the other components. The internal shock absorption means are in the form of strips of viscoelastic material having a transverse cross-section whose area and configuration vary along the length of the body of the ski as a function of the longitudinal position under consideration. That is to say, the present invention provides for a variation in the cross-sectional area and the shape of the strips along the length of the ski.

In the present invention, the shock absorption means are in the form of two longitudinally extending lateral strips of viscoelastic material, the strips being positioned on opposite lateral sides of the longitudinal core. The width of each strip is established by the spacing between a side wall of the strip and the corresponding lateral surface of the ski. The lateral side walls of the core are inclined relative to the sole of the ski and define angles of inclination A,B whose magnitude is a function of the length of the core. This arrangement confers to the body of the ski mechanical shock absorption properties which vary as a function of longitudinal position on the ski. As a consequence, the shock absorption properties of the ski are substantially improved. Moreover, this arrangement provides, in a simple manner, a ski that has shock absorption properties over a greater range of frequencies.

According to a preferred embodiment, the angles of inclination of the side walls of the core are defined such that the cross-section of the strip, both in the central zone of the ski and adjacent to the ends of the ski, is less than the cross-section of the strip adjacent the front quarter and adjacent the rear quarter of the contact zone of the ski. Shock absorption is thus at a maximum in the most stressed zones of the ski during its use with a boot affixed to the ski by a binding.

According to a preferred embodiment, the shock absorption strips are constituted by filling elements of viscoelastic material. The structure of the ski is thus considerably simplified.

The longitudinal variation in cross-section of the shock absorption strips can be achieved by providing a core whose width is constant over its length, and by providing a shock absorption strip on each lateral side of the core. The width of each strip is determined by the spacing between a lateral wall of the core and a facing lateral surface of the ski; and the thickness of each strip is determined by the spacing between the upper and lower walls of the ski. The usual transverse spacing between the lateral surfaces of the ski along its length, which is generally smaller in the central zone of the ski than at the ends, and the usual variation in thickness of the ski along its length, combine to produce a variation in the cross-sectional area of the shock absorption means. Such variation is made to conform to a desired variation by corrections effected by suitable variation in the angles of inclination of the lateral surfaces of the core.

Variations in the cross-section of the shock absorption means is preferably obtained when the lateral sides of the core are oblique relative to the sole of the ski, and have an inclination that varies along the length of the core. This can be achieved if the angle of inclination of at least one of the lateral surfaces of the core is a nonconstant function of the length of the core.

Such a variable shock absorption structure can be applied to skis having either a sandwich construction, or a casing resistance construction. Thus, skis constructed in either manner in accordance with the present invention will have improved gripping qualities by reason of the combination of the intrinsic qualities of the casing and the anti-vibrational effect that results from the structure according to the invention.

The shock absorption strips can be located symmetrically about the longitudinal axis of symmetry of the ski, i.e., symmetrically about a vertical, longitudinal median plane of the ski. However, the desired distributed shock absorption properties can be achieved when the shock absorption strips are asymmetrical about the median plane, or when the strips are symmetrical, but their cross-sectional areas vary as a function of the longitudinal position being considered along the length of the ski.

According to one embodiment, the angle A of inclination may assume a value very close to 90° in the central zone of the body of the ski. In this case, adjacent at least one of the two contact lines, the inclination angle A is preferably smaller, for example approximately 45°.

Preferably, the cross-section of the shock absorption elements varies continuously along the length of the body of the ski, producing a continuous variation of mechanical shock absorption.

BRIEF DESCRIPTION OF THE DRAWINGS

Embodiments of the present invention are shown in the accompanying drawings wherein:

FIG. 1 is a side view in cross-section of a ski according to the invention;

FIG. 2 is a top view and partial cross-section of the ski of FIG. 1;

FIG. 3 is a detailed transverse cross-section of the ski according to one embodiment of the invention;

DETAILED DESCRIPTION OF PREFERRED EMBODIMENTS

Figure 4:
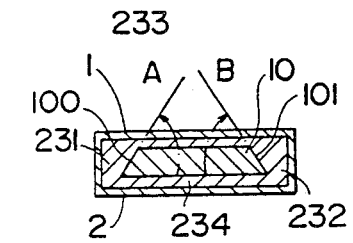
FIGS. 4, 5 and 6 are transverse cross-sections of the ski of FIG. 2 taken at vertical planes C—C, D—D and E—E, respectively, for a ski having a casing construction.

Referring first to FIG. 3 of the drawings, a ski according to the present invention includes upper surface 1, lower surface 2 (also referred to as a sole or sliding surface), first lateral exterior appearance surface 3, second lateral exterior surface 4, and a front end which is upwardly curved in the form of spatula 5 (FIG. 1). Lower surface 2 of the ski between front contact line 6 and rear contact line 7 defines a snow contact zone of the ski which, when not in use, may be arched upwardly or cambered. The body of the ski, or the portion of the ski included between front contact line 6 and rear contact line 7, has a maximum thickness in central zone 8, and a thickness which decreases progressively approaching both the front contact line 6 and rear contact line 7.

The ski may have, as shown in FIGS. 3–9, a symmetrical mechanical resistance casing structure with respect to vertical longitudinal median axis I—I of the ski which defines a longitudinal median plane. As shown in FIG. 3, the ski is constituted by four principle portions: core 10 having a substantially rectangular cross-section, shell 20, lower element 30, and filling 23.

Core 10 may be a cellular structure such as wood, synthetic foam, or aluminum honey-comb. The core may be partially hollow and may be constituted, for example, by metallic or plastic tubes.

Shell 20, in this embodiment, is a composite shell comprising outer exterior layer 21 of thermoplastic material, for example, and reinforcement layer 22 constituted from a material having high mechanical resistance such as stratified or alloyed aluminum, for example.

Exterior layer 21 may be a thermoplastic material such as ABS (acrylonitrile butadiene styrene), a polyamide, or a polycarbonate.

Reinforcement layer 22 may be one or more sheets or layers of woven glass, carbon or other material, these layers preferably being pre-impregnated with a thermoplastic resin such as a polyetherimide, or with a thermosetting resin such an epoxyde, or a polyurethane. The fabric is preferably oriented, and may have 90% of its fibers arranged in the longitudinal direction of the ski, and 10% in the transverse direction of the ski.

Interior filling layer 23, of viscoelastic material, ensures a linkage or connection between core 10 and reinforcement layer 22. The application to skis of viscoelastic material to provide shock absorption is described in the previously noted patents identified above. As is known, a suitable viscoelastic material can be selected from thermoplastic materials, synthetic resins, silicon elastomers, rubbers, butyl polychloroprenes, acrylic nitriles, ethylenes, propylenes, and ionomers. Such viscoelastic materials have properties that lie between those of a solid and a liquid, and serve to at least partially absorb shock and deformation forces. In liquids, stress is directly proportional to the rate of deformation; and in solids, stress is directly proportional to deformation. In a viscoelastic material, however, stress is a function of both the rate of deformation and of the deformation itself. In all of the embodiments, viscoelastic filling layer 23 is securely attached to the mechanical resistance elements by bonding or any other known process.

Lower element 30 comprises sole 31 of polyethylene constituting lower or sliding surface 2 of the ski. Lateral corner angles 32, 33 at the lateral edges of sole 2 are of steel; and lower resistance layer 34 is a mechanically resistant material. For example, lower resistance layer 34 may have a composite structure comprising glass fibers and aluminum alloy or stratified aluminum. Lower resistance layer 34 is integrated along its lateral edges with with the corresponding lower lateral edges of reinforcement layer 22 of shell 20.

Reinforcement layer 22 of shell 20 has, as shown in the drawings, a cross-section in the form of an inverted U-shaped structure which constitutes an upper resistance layer connected to two lateral resistance layers attached at their lower edges to the lateral edges of lower resistance layer 34. As a result, reinforcement layer 22 of the shell and of the lower resistance layer 34 comprise an enclosed casing structure that surrounds core 10.

In the embodiment of FIG. 3, lateral surfaces 3 and 4 of the ski are inclined; and their inclination may be a nonconstant function of the length of the ski. Such an arrangement is compatible with the present invention; and in such case, the lateral walls of the core may vary with length in a way that matches the variation in inclination of the lateral surfaces of the body similar to what is shown in FIGS. 4–11.

Figure 5:
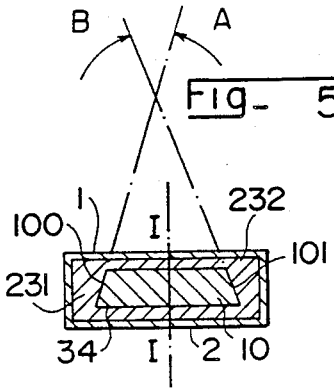
Figure 6:
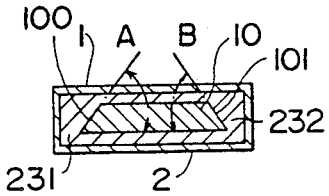

In the embodiments of FIGS. 4–9, lateral surfaces 3 and 4 of the ski are vertical, i.e., perpendicular to the upper surface 1 and lower surface 2 of the ski, and parallel to median plane I—I. In the embodiment of FIGS. 4–6, the inclination angles A and B of the lateral walls of the core are nonconstant functions of the length of the core. Thus, the central zone of the core has a trapezoidal cross-section as shown in FIG. 5. Lateral walls 100, 101 are inclined upwardly with respect to the longitudinal median plane I—I of the ski. Lateral walls 100, 101 are inclined relative to lower resistance layer 34 at interior angles A or B, termed inclination angles. The value of these angles in the central zone of the ski is approximately 90°.

In FIG. 4, which shows the rear intermediate zone of the ski taken at C—C, the body thickness is reduced. In addition, inclination angles A, B are also reduced. Preferably, at section C—C, the inclination angles are approximately 60° as shown in FIG. 4. Likewise, in the front intermediate zone of the ski shown in FIG. 6, which is a section taken at E—E, the thickness of the body is reduced, and the inclination angles A, B are also reduced. However, the reduction in the value of the inclination angles is more pronounced in the front intermediate zone as compared to the rear intermediate zone. Preferably, the inclination angles in the front intermediate zone are approximately 45° as shown in FIG. 4.

According to the present invention, core 10 has a shape that varies as a function of the longitudinal position being considered along the length of the ski, but has a constant width independent of length. Filling layer 23, of viscoelastic material, comprises first longitudinally extending lateral strip 231 having a generally triangular transverse cross-section, second longitudinally extending lateral strip 232 also having a generally triangular cross section, third upper longitudinal strip 233, and fourth lower longitudinal strip 234. Strips 231 and 232 are integrally connected by upper and lower strips 233 and 234 which form plates.

Variations in the inclination of lateral Walls 100, 101 of the core as a function of the longitudinal position being considered along the length of the ski results in lengthwise variations in area, shape and cross-section of the lateral strips 231 and 232. For example, the cross-section of viscoelastic material surrounding core 10 is greater in FIG. 4 and 6, i.e., adjacent the front and rear quarters, respectively, of the ski, than in the central zone shown in FIG. 5.

Angles A and B are acute angles that measure the respective inclinations of lateral Walls 100, 101 of the core with respect to the lower surface of the core. That is to say, angles A and B are acute angles with respect to lower surface 2 of the ski, or to lower resistance layer 34 of the ski.

Figure 10:
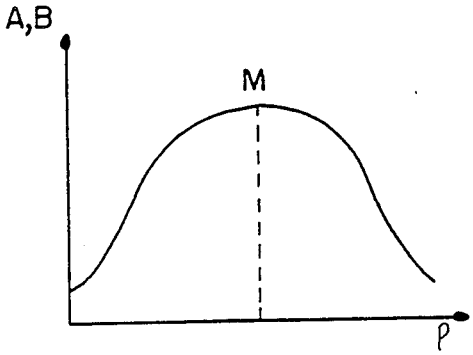
FIG. 10 is a graph that illustrates a typical variation in inclination angles A and B, according to the invention in the embodiment of FIGS. 4–6.

Preferably, as shown in the embodiment of FIGS. 4 and 6, inclination angles A and B vary continuously along the length of the ski. An example of a particularly suitable variation is illustrated in FIG. 10 which shows that angles A and B are a maximum in central zone 8 of the ski, and continuously decrease with displacement from this zone toward the front and rear contact lines of the ski. As a result, the transverse cross-section of lateral strips 231 and 232 is a minimum adjacent the central zone 8 of the ski, and increases with distance away from this zone toward the extremities of the ski. In this embodiment the lateral walls 100 and 101 of the core are inclined upwardly towards the upper surface of the ski, over the entire length of the body of the ski. The term "inclined upwardly" means that an imaginary extension of the lateral walls of the core meet at a point lying in median plane I—I above top surface 1 of the ski.

Figure 7:
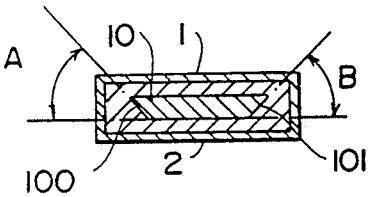
FIGS. 7, 8 and 9 are transverse cross-sections of the ski of FIG. 2 taken at vertical planes C—C, D—D and E—E, respectively, for a ski having another casing construction.
Figure 8:
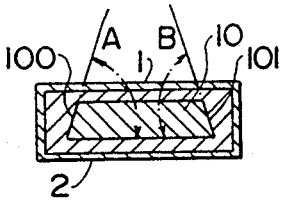
Figure 9:
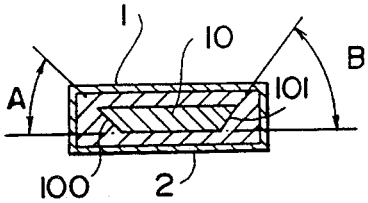
Figure 11:
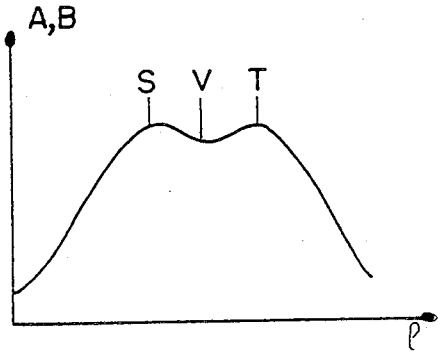
FIG. 11 is a graph that illustrates a typical variation in inclination angles A and B, according to the invention in the embodiment of FIGS. 7–9.

In the embodiment shown in FIGS. 7—9, lateral walls 100 and 101 of the core are inclined upwardly in the central zone of the body of the ski; but, as shown in FIG. 9, the lateral walls are inclined downwardly towards lower surface 2 of the ski adjacent the forward and rearward ends of the body of the ski. The term "inclined downwardly" means that an imaginary extension of the lateral walls of the core meet at a point lying in median plane I—I below top surface 1 of the ski. FIG. 11 is a curve illustrating another typical variation of angles A and B with length along the ski. As shown, the curve has double maxima defining a slight hollow V in the central portion located in the central zone of the ski. Hollow V is located between apices S and T for which angles A and B are equal to 90°. From these maxima, angles A and B decrease monotonically in the direction of the ends of the body of the ski.

Preferably, the structure of the ski is symmetrical with respect to longitudinal vertical median plane I—I of the ski. However, similar shock absorption effects can be obtained, according to the invention, by utilizing a ski or a core having an asymmetrical transverse cross-section.

The presence of exterior layer 21 is not indispensable for obtaining the particular effects according to the invention. Thus, a ski structure according to the present invention may include exterior layer 21 and reinforcement layer 22 combined into a single reinforcement layer.

The proceeding embodiments have been described with reference to a casing mechanical resistance structure. The invention is also applicable to form shock absorption elements within the context of a sandwich type mechanical resistance structure.

The ski according to the invention can be made by traditional means, for example by a process described in French Patent No. 985,174. However, the ski according to the invention can likewise be manufactured according to a process described in French Patent No. 87 03119.

While the invention has been described with reference to particular means, materials and embodiments, it is not limited to the particulars disclosed but extends to all equivalents within the scope of the appended claims.

We claim:

1. A ski for use of snow comprising a longitudinally extending body defining a vertical longitudinal median plane and having a sole substantially perpendicular thereto for slidably engaging a surface, said sole having a central zone lying between front and rear contact lines, the width of said body being established by opposed lateral surfaces, and the thickness of said body being established by an upper wall opposed to said sole, a longitudinal core extending along the length of the body between front and rear ends of the ski and whose width is established by lateral side walls that respectively face the lateral surfaces of the body, and whose thickness is established by upper and lower walls, mechanical resistance elements, and filling means in the form of internal longitudinal shock absorption means made of a viscoelastic material connecting the resistance elements to the core wherein:

a) said internal shock absorption means including a pair of lateral strips of visoelastic material, each strip being sandwiched between one of said opposed lateral surfaces of said body and the facing lateral wall of the core; and b) lateral side walls of said core making respective inclination angles A and B with the sole of the body, said inclination angles being a nonconstant function of the length of the core for effecting mechanical shock absorption properties which vary longitudinally along the body.

2. A ski according to claim 1, wherein the largest width of said core is substantially constant along the length thereof.

3. A ski according to claim 1, wherein the inclination angles A and B of the lateral side walls of the core in said central zone exceed the inclination angles A and B adjacent the rear contact line of the ski.

4. A ski according to claim 1, wherein the lateral side walls of the core are symmetrical with respect to said vertical longitudinal median plane.

5. A ski according to claim 1, wherein the lateral side walls of the core are asymmetrical with respect to said vertical longitudinal median plane.

6. A ski according to claim 1, wherein the inclination angles A and B are substantially equal to 90° in said central zone.

7. A ski according to claim 1, wherein the inclination angles A and B vary continuously along the length of the body of the ski.

8. A ski according to claim 1, wherein the lateral side walls of the core are inclined upwardly towards the upper wall of the ski over the entire length thereof.

9. A ski according to claim 8, wherein the inclination angles are equal at a given axial cross-section of the ski.

10. A ski according to claim 8, wherein the inclination angles in the central zone of the ski are approximately 90°.

11. A ski according to claim 10, wherein the inclination angles decrease monotonically from the central zone toward the axial ends of the ski.

12. A ski according to claim 11, wherein the inclination angles are equal to approximately 45° in a front intermediate zone of the ski located between the central zone and the front contact line.

13. A ski according to claim 11, wherein the inclination angles are approximately 60° in a rear intermediate zone of the ski located between the central zone and the rear contact line.

14. A ski according to claim 13, wherein the inclination angles are approximately 60° in the front intermediate zone.

15. A ski according to claim 8, wherein the inclination angles in the central zone of the ski are less than 90°.

16. A ski according to claim 15, wherein the inclination angles increase to about 90° from the values in the central zone on each side thereof toward the axial ends of the ski.

17. A ski according to claim 16, wherein the inclination angles decrease from about 90° to the axial ends of the ski.

18. A ski according to claim 1, wherein the lateral side walls of the core are inclined upwardly towards the upper wall of the body in said central zone and are inclined downwardly towards the sole of the ski adjacent the front and rear contact lines.

19. A ski according to claim 1, wherein the strips are connected by an upper linkage layer of viscoelastic material, said upper layer being sandwiched between the upper wall of the body and the upper wall of the core.

20. A ski according to claim 1, wherein the strips are connected by a lower linkage layer of viscoelastic material, said lower layer being sandwiched between the sole of the body and the lower wall of the core.

21. A ski according to claim 1, wherein said mechanical resistance elements include an upper mechanical resistance layer and a lower mechanical resistance layer for forming a sandwich construction.

22. A ski according to claim 1, wherein said mechanical resistance elements include a shell having a U-shaped cross-section closed by a lower mechanical resistance layer forming a casing structure surrounding the core.

23. A ski for use on snow comprising a longitudinally extending body defining a longitudinal median plane and having a sole substantially perpendicular thereto for slidably engaging a surface, said sole having a central zone lying between front and rear contact lines, the width of said body being established by opposed lateral surfaces, and the thickness of said body being established by an upper wall opposed to said sole, a longitudinal core extending along the length of the body between front and rear ends of the ski and whose width is established by lateral side walls that respectively face the lateral surfaces of the body, and whose thickness is established by upper and lower walls, mechanical resistant elements, and filling means in the form of internal longitudinal shock absorption means made of a viscoelastic material connecting the resistance elements to the core wherein:

a) said internal shock absorption means including a pair of lateral strips of viscoelastic material, each strip being sandwiched between a lateral surface of said body and the facing lateral wall of the core;

b) lateral side walls of said core making respective inclination angles A and B with the sole of the body, said inclination angles being a nonconstant function of the length of the core for effecting mechanical shock absorption properties which vary longitudinally along the body; and c) wherein the inclination angles A and B of the lateral side walls of the core in said central zone exceed the inclination angles A and B adjacent the front contact line of the ski.

24. A ski according to claim 23, wherein said inclination angles in the central zone of the ski are greater than the corresponding inclination angles near the rear contact line of the ski.

25. A ski according to claim 23, wherein the inclination angles A and B, at a given longitudinal position on the ski, are equal.

26. A ski according to claim 25, wherein the inclination angles A and B in the central zone of the ski are approximately equal to 90°.

27. A ski according to claim 26, wherein the inclination angles decrease monotonically toward the axial ends of the ski.

28. A ski according to claim 27, wherein the inclination angles are equal to approximately 45° in a front intermediate zone of the ski located between the central zone and the front contact line.

29. A ski according to claim 27, wherein the inclination angles A and B are approximately 60° in a rear intermediate zone of the ski located between the central zone and the rear contact line.

30. A ski according to claim 29, wherein the inclination angles A and B are approximately 45° in a front intermediate zone located between the central zone and the front contact line.

31. A ski according to claim 25, wherein the inclination angles in the central zone of the ski are less than 90°.

32. A ski according to claim 31, wherein the inclination angles increase to about 90° from the values in the central zone on each side thereof toward the axial ends of the ski.

33. A ski according to claim 32, wherein the inclination angles decrease from about 90° to the axial ends of the ski.

34. A ski for use on show comprising:

a) a longitudinally extending body defining a vertical longitudinal median plane and having a sole substantially perpendicular thereto for slidably engaging a surface, said sole having a central zone lying between front and rear contact lines, the width of said body being established by opposed lateral surfaces, and the thickness of said body being established by an upper wall opposed to said sole;

b) a longitudinal core extending along the length of the body between front and rear ends of the ski and whose width is established by lateral side walls that respectively face the lateral surfaces of the body, and whose thickness is established by upper and lower walls;

c) internal longitudinal shock absorption means made of a viscoelastic material;

d) said internal shock absorption means being in the form of a pair of lateral strips of viscoelastic material, each strip being sandwiched between one of said opposed lateral surfaces of said body and the facing lateral wall of the core; and e) the lateral side walls of said core making respective inclination angles A and B with the sole of the body, said inclination angles being a nonconstant function of the length of the core for effecting mechanical shock absorption properties which vary longitudinally along the body.

35. A ski according to claim 34, wherein the inclination angles A and B of the lateral side walls of the core in said central zone exceed the inclination angles A and B adjacent the front contact line of the ski.

36. A ski according to claim 34, wherein the inclination angles A and B of the lateral side walls of the core in said central zone exceed the inclination angles A and B adjacent the rear contact line of the ski.

37. A ski according to claim 34, wherein the lateral side walls of the core are symmetrical with respect to said vertical longitudinal median plane.

38. A ski according to claim 34, wherein the lateral side walls of the core are asymmetrical with respect to said vertical longitudinal median plane.

39. A ski according to claim 34, wherein the inclination angles A and B are substantially equal to 90° in said central zone.

40. A ski according to claim 34, wherein the inclination angles A and B vary continuously along the length of the body of the ski.

41. A ski according to claim 34, wherein the lateral side walls of the core are inclined upwardly towards the upper wall of the ski over the entire length thereof.

42. A ski according to claim 34, wherein the lateral side walls of the core are inclined upwardly towards the upper wall of the body in said central zone and are inclined downwardly towards the sole of the ski adjacent the front and rear contact lines.

* * * * *